US012064009B2

(12) United States Patent
Foxen

(10) Patent No.: US 12,064,009 B2
(45) Date of Patent: Aug. 20, 2024

(54) ARTICLE OF FOOTWEAR WITH BANKING MIDSOLE WITH EMBEDDED RESILIENT PLATE

(71) Applicant: NIKE, Inc., Beaverton, OR (US)

(72) Inventor: Thomas Foxen, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/005,397

(22) Filed: Aug. 28, 2020

(65) Prior Publication Data

US 2020/0390191 A1 Dec. 17, 2020

Related U.S. Application Data

(60) Continuation of application No. 15/989,257, filed on May 25, 2018, now Pat. No. 10,765,172, which is a (Continued)

(51) Int. Cl.
*A43B 13/42* (2006.01)
*A43B 13/12* (2006.01)
(Continued)

(52) U.S. Cl.
CPC ..... *A43B 13/42* (2013.01); *A43B 13/125* (2013.01); *A43B 13/14* (2013.01); *A43B 13/181* (2013.01); *A43B 13/187* (2013.01); *A43B 13/188* (2013.01)

(58) Field of Classification Search
CPC ..... A43B 17/06; A43B 17/04; A43B 13/183; A43B 13/185; A43B 13/125;
(Continued)

(56) References Cited

U.S. PATENT DOCUMENTS 1,659,339 A 2/1928 Franz
1,704,187 A 3/1929 Glidden
(Continued)

FOREIGN PATENT DOCUMENTS

DE 1881914 U 10/1963
DE 102012110573 A1 5/2014
(Continued)

OTHER PUBLICATIONS

The International Search Report and the Written Opinion of the International Searching Authority, dated Jul. 15, 2015 for PCT Application No. PCT/US2015/032811.

*Primary Examiner* — F Griffin Hall
(74) *Attorney, Agent, or Firm* — Honigman LLP; Matthew H. Szalach; Jonathan P. O'Brien

(57) ABSTRACT

An article of footwear may include an upper and a sole structure secured to the upper. The sole structure includes a midsole, an outsole secured to the midsole, and one or more plates positioned within the midsole. Each of the plates has a downwardly-facing concave side and an upwardly-facing concave side. The downwardly-concave side may be positioned on a medial side (or a lateral side) of the footwear, and the upwardly-concave side may be positioned on the lateral side (or the medial side) of the footwear. The undulating medio-lateral configuration of each plate may increase the overall support provided to a wearer's foot during a side-to-side or "banking" movement.

15 Claims, 15 Drawing Sheets

Related U.S. Application Data division of application No. 14/447,360, filed on Jul. 30, 2014, now Pat. No. 10,010,137.

(51) Int. Cl.
*A43B 13/14* (2006.01)
*A43B 13/18* (2006.01)

(58) Field of Classification Search
CPC ..... A43B 13/127; A43B 13/42; A43B 13/14; A43B 13/181; A43B 13/187; A43B 13/188; A43B 13/12; A43B 13/16; A43B 13/18
USPC .... 36/103, 107, 108, 76 R, 76 C, 72 A, 182, 36/167, 148, 30 R, 31, 22 A, 28, 29, 102, 36/142, 143, 144
See application file for complete search history.

(56) References Cited

U.S. PATENT DOCUMENTS

| | | | | |
|---|---|---|---|---|
| 3,100,354 | A | 8/1963 | Lombard et al. | |
| 3,629,962 | A | 12/1971 | Brock | |
| 3,878,626 | A | 4/1975 | Isman | |
| 4,561,195 | A | 12/1985 | Onoda et al. | |
| 4,878,300 | A | 11/1989 | Bogaty | |
| 5,025,573 | A | 6/1991 | Giese et al. | |
| 5,280,680 | A | 1/1994 | Burke et al. | |
| 5,319,866 | A * | 6/1994 | Foley | A43B 5/00 36/31 |
| 5,337,492 | A | 8/1994 | Anderie et al. | |
| 5,528,842 | A * | 6/1996 | Ricci | A43B 21/30 36/38 |
| 5,572,805 | A * | 11/1996 | Giese | A43B 13/188 36/31 |
| 5,642,575 | A | 7/1997 | Norton et al. | |
| 5,720,118 | A | 2/1998 | Mayer et al. | |
| 5,930,916 | A | 8/1999 | Connor | |
| 6,023,861 | A | 2/2000 | Bizzotto | |
| 6,167,639 | B1 | 1/2001 | Ventura | |
| 6,212,795 | B1 | 4/2001 | Nakabe et al. | |
| 6,389,713 | B1 * | 5/2002 | Kita | A43B 13/18 36/31 |
| 6,401,365 | B2 * | 6/2002 | Kita | A43B 13/12 36/31 |
| 6,763,615 | B2 | 7/2004 | Mitsui et al. | |
| 6,964,120 | B2 | 11/2005 | Cartier et al. | |
| 7,082,702 | B2 * | 8/2006 | Cretinon | A43B 13/141 36/76 R |
| 7,162,815 | B2 | 1/2007 | Miyauchi | |
| 7,370,443 | B2 | 5/2008 | Gibert | |
| 7,421,805 | B2 * | 9/2008 | Geer | A43B 3/0057 36/31 |
| 7,793,432 | B2 | 9/2010 | Chan et al. | |
| 8,074,377 | B2 * | 12/2011 | Nishiwaki | A43B 13/141 36/28 |
| 8,151,485 | B2 * | 4/2012 | Hurd | A43B 13/184 36/103 |
| 8,387,279 | B2 * | 3/2013 | Pauk | A43B 13/122 36/27 |
| 10,010,137 | B2 | 7/2018 | Foxen | |
| 2002/0014022 | A1 | 2/2002 | Kita | |
| 2003/0000108 | A1 | 1/2003 | Kita | |
| 2003/0000109 | A1 | 1/2003 | Kita | |
| 2003/0005600 | A1 | 1/2003 | Kita | |
| 2005/0050770 | A1 | 3/2005 | Gyr | |
| 2006/0137228 | A1 * | 6/2006 | Kubo | A43B 13/12 36/31 |
| 2007/0294915 | A1 | 12/2007 | Ryu | |
| 2008/0010863 | A1 | 1/2008 | Auger et al. | |
| 2011/0146104 | A1 | 6/2011 | Lafortune | |
| 2011/0197468 | A1 * | 8/2011 | Kubo | A43B 13/12 36/28 |
| 2011/0232130 | A1 | 9/2011 | Boudreau et al. | |
| 2013/0091739 | A1 * | 4/2013 | Yang | A43B 13/188 36/30 R |
| 2013/0199057 | A1 * | 8/2013 | Hurd | A43B 13/184 36/88 |
| 2014/0237860 | A1 * | 8/2014 | Spanks | A43B 13/026 36/30 R |
| 2018/0213884 | A1 | 8/2018 | Kim | |

FOREIGN PATENT DOCUMENTS

| | | | |
|---|---|---|---|
| EP | 0922400 | A1 | 6/1999 |
| EP | 2975962 | A2 | 1/2016 |
| EP | 3001924 | A1 | 4/2016 |
| KR | 101638304 | B1 | 7/2016 |
| WO | WO-2016165734 | A1 | 10/2016 |
| WO | WO-2017058419 | A1 | 4/2017 |

* cited by examiner

ARTICLE OF FOOTWEAR WITH BANKING MIDSOLE WITH EMBEDDED RESILIENT PLATE

CLAIM OF PRIORITY AND CROSS-REFERENCE TO RELATED APPLICATION

This application is a continuation of U.S. patent application Ser. No. 15/989,257, filed May 25, 2018, which is a divisional of U.S. patent application Ser. No. 14/447,360, filed on Jul. 30, 2014, the disclosures of which are hereby incorporated by reference in their entireties and for all purposes.

BACKGROUND

Articles of footwear generally include two primary elements, an upper and a sole structure. The upper is formed from a variety of material elements (e.g., textiles, foam, leather, and synthetic leather) that are stitched or adhesively bonded together to form a void on the interior of the footwear for comfortably and securely receiving a foot. An ankle opening through the material elements provides access to the void, thereby facilitating entry and removal of the foot from the void. In addition, a lace may be utilized to modify the dimensions of the void and secure the foot within the void.

The sole structure is located adjacent to a lower portion of the upper and is generally positioned between the foot and the ground. In many articles of footwear, including athletic footwear, the sole structure generally incorporates an insole, a midsole, and an outsole. The insole, which may be located within the void and adjacent to a lower surface of the void, is a thin compressible member that enhances footwear comfort. The midsole, which may be secured to a lower surface of the upper and extends downward from the upper, forms a middle layer of the sole structure. In addition to attenuating ground reaction forces (i.e., providing cushioning for the foot), the midsole may limit foot motions or impart stability, for example. The outsole, which may be secured to a lower surface of the midsole, forms the ground-contacting portion of the footwear and is usually fashioned from a durable and wear-resistant material that includes texturing to improve traction.

Generally, the midsole is the primary source of cushioning for the article of footwear, and it is primarily formed from a foamed polymer material, such as polyurethane or ethyl-vinylacetate, that extends throughout a length and width of the footwear. In some articles of footwear, the midsole may include a variety of additional footwear elements that enhance the comfort or performance of the footwear, including plates, moderators, fluid-filled chambers, lasting elements, or motion control members. In some configurations, any of these additional footwear elements may be located between the midsole and the upper, located between the midsole and the outsole, embedded within the midsole, or encapsulated by the foamed polymer material of the midsole, for example. Although many midsoles are primarily formed from a foamed polymer material, fluid-filled chambers or other non-foam structures may form a majority of some midsole configurations.

Midsoles tend to optimize support and cushioning comfort for a wearer when walking or running. The forces acting on the midsole during these activities tend to be directed vertically and in a forward and aft direction relative to the article of footwear. Midsoles are designed to return predictable and consistent cushioning comfort and support when encountering these forces.

Side-to-side or "banking" movement, particularly among athletes like football, basketball and tennis players, is also common. Usually, it is desirable for athletes to quickly change his or her side-to-side direction when banking. Accordingly, many athletes prefer more stable and supportive footwear with less cushioning during these banking maneuvers. However, footwear, and in particular midsoles, tend to offer the same or a similar level of cushioning and support throughout the entire range of use of the footwear whether when walking, running or banking.

SUMMARY

Plates may be added to sole structures of articles of footwear in order to modify various physical properties of the footwear. For example, a midsole may be formed of a polymer foam material, and a plate formed of a more rigid material may be embedded in the midsole. Such embedded plates may modify the footwear's flexibility and durability, for example, as well as the footwear's support properties such as resilience and springiness.

When a plate embedded in a midsole has a curved or otherwise arcuate configuration, some portions of the plate may react differently to various forces than other portions. For example, if a plate is formed to include portion having a curvature that is concave or opening in a downward direction, a downward force on that portion may at least partially translate into both a downward displacement of that portion of the plate and an outward or sideways displacement of adjacent portions of the plate.

The support properties provided by curved plates may be particularly advantageous during "banking" (e.g., leaning to one side or pushing off to the side from the medial or lateral side of the foot). A curved plate may simultaneously permit local compression in one area of the midsole while providing additional support in another.

In one aspect, the disclosure provides a sole structure for an article of footwear comprising a resilient midsole and a ground-engaging outsole. The midsole includes a curved plate and a polymer foam material. The curved plate has a first concavity facing downward and a second concavity facing upward. The second concavity is positioned between the first concavity and either a lateral edge of the midsole or a medial edge of the midsole.

In another aspect, the disclosure provides an article of footwear having an upper forming an interior void and a sole structure comprising a midsole, an outsole, and a plate. The midsole is secured to a lower surface of the upper and includes a polymer foam material. The outsole is secured to a lower surface of the midsole, includes a rubber material, and forms a ground-engaging portion of the footwear. The plate is at least partially embedded in the midsole and has an undulating medio-lateral curvature.

In yet another aspect, the disclosure provides an article of footwear having an upper and a sole structure secured to the upper. The sole structure comprises a midsole formed from a polymer foam material and an outsole forming a ground-engaging portion of the footwear. The midsole incorporates a curved plate having a first side with a downwardly-oriented first edge, a second side with an upwardly-oriented second edge, and an inflection region located between the first side and the second side. Both the first edge and the second edge are spaced inward from a peripheral edge of the midsole.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the invention, and be protected by the following claims. Moreover, this disclosure expressly includes any and all combinations and subcombinations of the elements and features presented above and below.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

The following discussion and accompanying figures disclose various configurations of sole structures. Concepts associated with the sole structures may be applied to a wide range of athletic footwear styles, including basketball shoes, cross-training shoes, football shoes, golf shoes, hiking shoes and boots, ski and snowboarding boots, soccer shoes, tennis shoes, and walking shoes, for example. Concepts associated with the sole structures may also be utilized with footwear styles that are generally considered to be non-athletic, including dress shoes, loafers, and sandals.

General Footwear Structure

Figure 1:
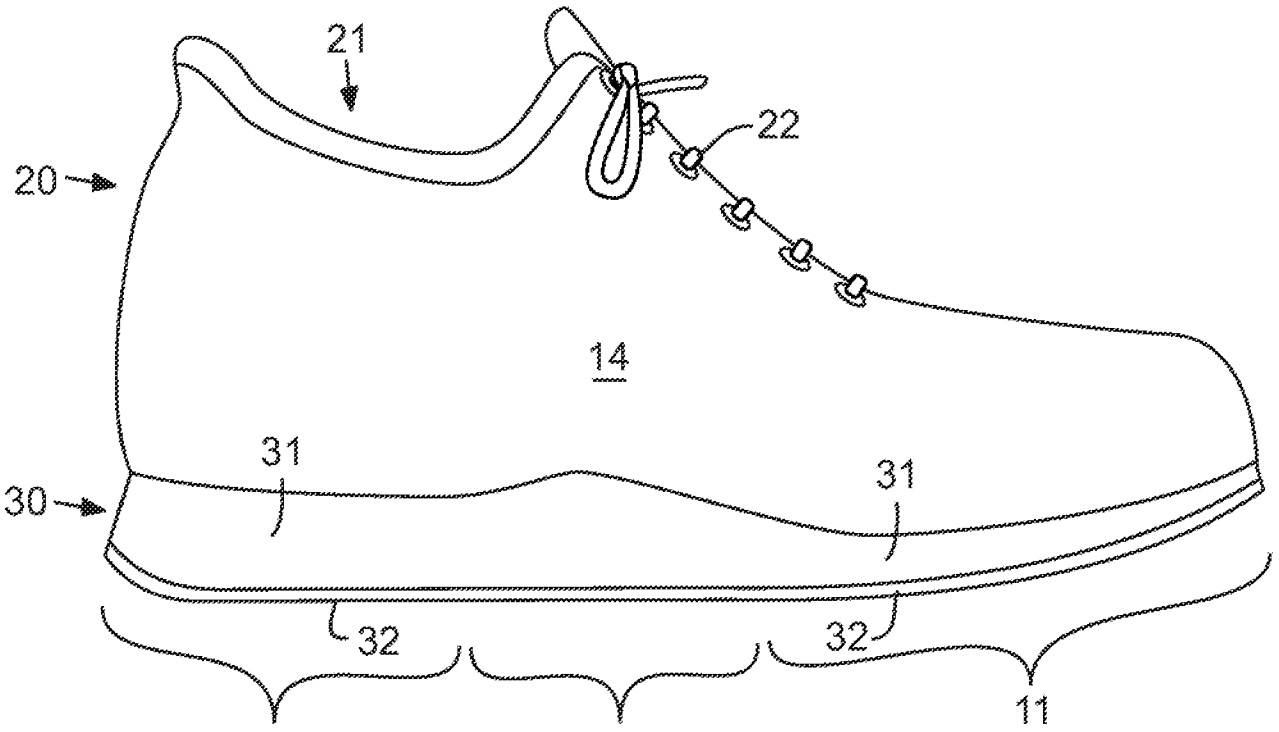
FIG. 1 is a lateral side elevational view of an article of footwear.
Figure 2:
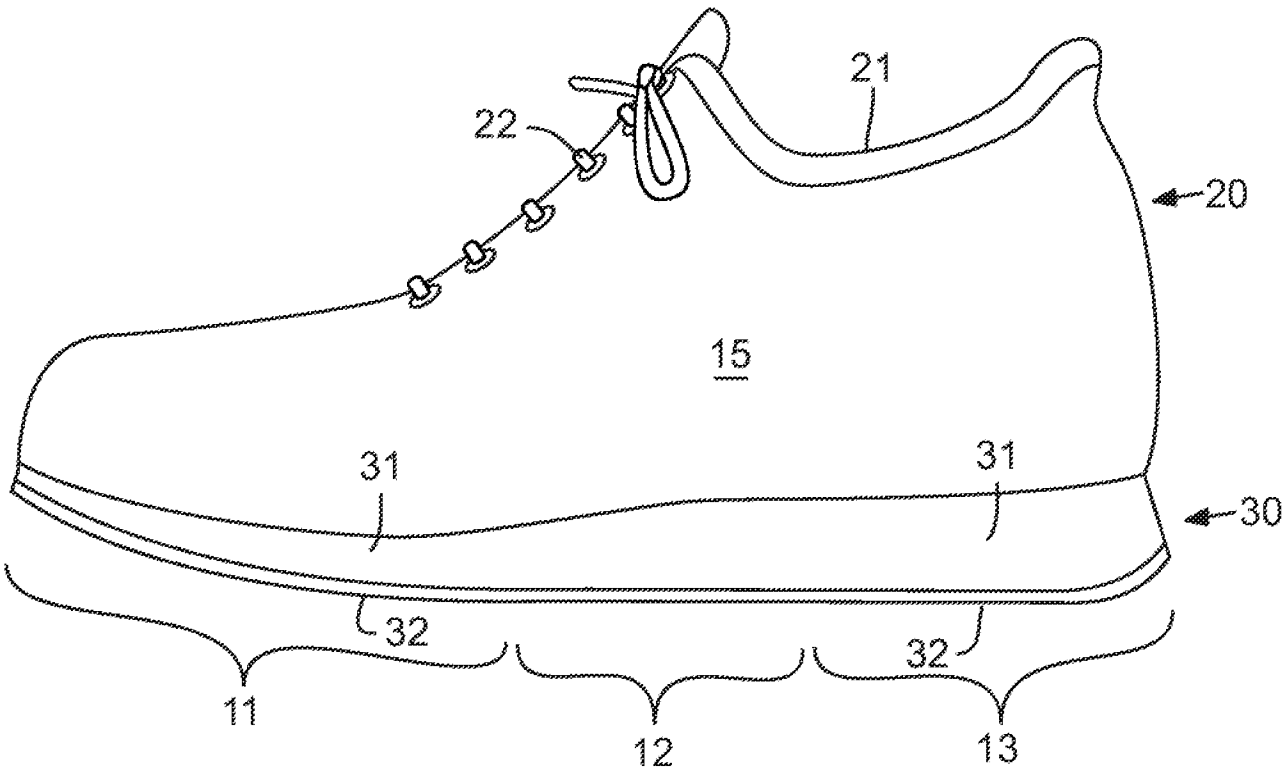
FIG. 2 is a medial side elevational view of the article of footwear.

An article of footwear 10 is depicted in FIGS. 1 and 2 as including an upper 20 and a sole structure 30. For reference purposes, footwear 10 may be divided into three general regions: a forefoot region 11, a midfoot region 12, and a heel region 13, as shown in FIG. 1. Footwear 10 also includes a lateral side 14 and a medial side 15. Forefoot region 11 generally includes portions of footwear 10 corresponding with the toes and the joints connecting the metatarsals with the phalanges. Midfoot region 12 generally includes portions of footwear 10 corresponding with the arch area of the foot. Heel region 13 generally includes portions of footwear 10 corresponding with rear portions of the foot, including the calcaneus bone. Lateral side 14 and medial side 15 extend through each of regions 11-13 and correspond with opposite sides of footwear 10.

Regions 11-13 and sides 14-15 are not intended to demarcate precise areas of footwear 10. Rather, regions 11-13 and sides 14-15 are intended to represent general areas of footwear 10 to aid in the following discussion. In addition to footwear 10, regions 11-13 and sides 14-15 may also be discussed with respect to the individual elements thereof, such as upper 20 and sole structure 30, and to the foot itself.

Upper 20 is depicted as having a substantially conventional configuration incorporating a variety of material elements (e.g., textile, foam, leather, and synthetic leather) that are stitched or adhesively bonded together to form an interior void for securely and comfortably receiving a foot. The material elements may be selected and located with respect to upper 20 in order to selectively impart properties of durability, air-permeability, wear-resistance, flexibility, and comfort, for example. An ankle opening 21 in heel region 13 provides access to the interior void. In addition, upper 20 may include a lace 22 that is utilized in a conventional manner to modify the dimensions of the interior void, thereby securing the foot within the interior void and facilitating entry and removal of the foot from the interior void. Lace 22 may extend through apertures in upper 20, and a tongue portion of upper 20 may extend between the interior void and lace 22.

Given that various aspects of the present application primarily relate to sole structure 30, upper 20 may exhibit the general configuration discussed above or the general configuration of practically any other conventional or non-conventional upper. Accordingly, the overall structure of upper 20 may vary significantly.

Sole structure 30 is secured to upper 20 and has a configuration that extends between upper 20 and the ground. In effect, therefore, sole structure 30 is located to extend between the foot and the ground. In addition to attenuating ground reaction forces (i.e., providing cushioning for the foot), sole structure 30 may provide traction, impart stability, and limit various foot motions, such as pronation.

The primary elements of sole structure 30 are a midsole 31 and an outsole 32. Midsole 31 may include a fluid-filled chamber. In addition, midsole 31 may incorporate one or more additional footwear elements that enhance the comfort, performance, or ground reaction force attenuation properties of footwear 10, including a polymer foam material, such as polyurethane or ethylvinylacetate, plates, moderators, lasting elements, or motion control members. Outsole 32, which may be absent in some configurations of footwear 10, is secured to a lower surface of midsole 31 and may be formed from a rubber material that provides a durable and wear-resistant surface for engaging the ground. In addition, outsole 32 may also be textured to enhance the traction (i.e., friction) properties between footwear 10 and the ground.

Sole structure 30 may also incorporate an insole or sockliner that is located within the void in upper 20 and adjacent (i.e., located nearby or close to, although not necessarily in contact with) a plantar surface or lower surface of the foot to enhance the comfort of footwear 10. A footplate may be operably received above the midsole to improve support.

Curved Plate Configurations

FIGS. 3-6 depict footwear 10 as incorporating a plurality of curved plates 40, two positioned in forefoot region 11 and one positioned in heel region 13. Each curved plate 40 has a first side 42 and a second side 62. For each curved plate 40, first side 42 includes a first concavity facing downward and a second side 62 includes a second concavity facing upward. Each curved plate 40 also includes a downwardly-oriented first edge 44 adjacent to first side 42 and an upwardly-oriented second edge 64 adjacent to second side 62. In the examples shown in FIGS. 5, 6 and 8, the first lateral edge 44 of the curved plate 40 is positioned below a horizontal plane passing through an inflection region 50 located between the first and second lateral sides 42, 62, whereas the second lateral edge 64 is positioned above the horizontal plane passing through this inflection region 50.

Figure 4:
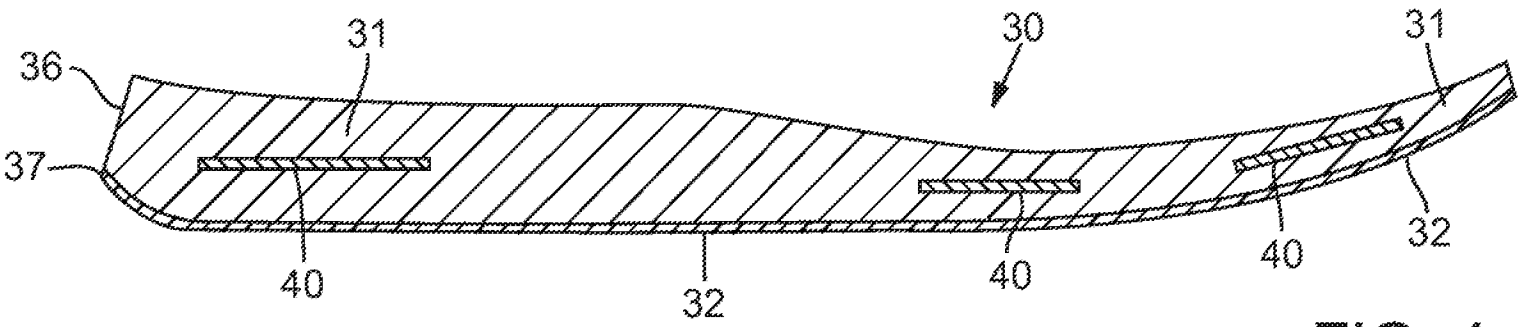
FIG. 4 is a cross-sectional view of a sole structure of the article of footwear, as defined by section line 4-4 in FIG. 3.

As depicted, the downwardly-concave first sides 42 are positioned on the medial side 15 of footwear 10, and the upwardly-concave second sides 62 are positioned on the lateral side 14 of footwear 10. Curved plates 40 are embedded within and surrounded by a polymer foam material of the midsole 31. Each curved plate 40 is accordingly spaced inward on its sides from both a peripheral edge 36 of the midsole 31 and a peripheral edge 37 of the outsole 32, and is also spaced from both an upper surface and a lower surface of the midsole 31. As shown in FIG. 4, each curved plate 40 has a substantially straight or rectilinear lateral cross-section. In other words, the plates 40 are illustrated in FIG. 4 without any curvature—sans upward concavity and sans downward concavity—in the forward and aft direction relative to the footwear 10.

Figure 7:
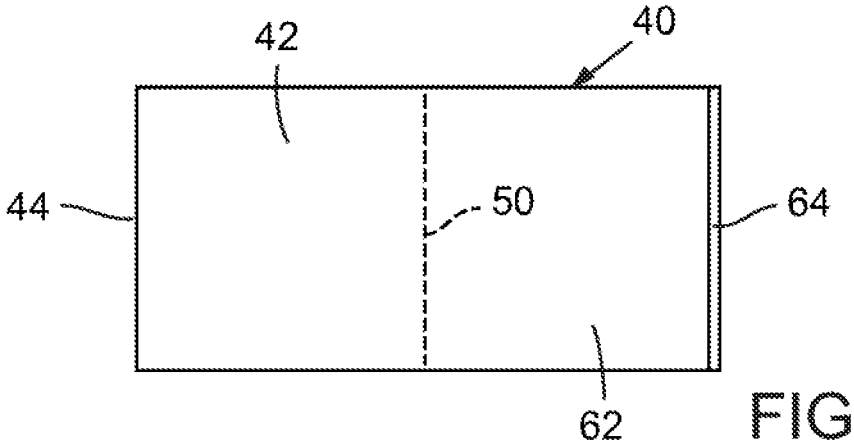
FIG. 7 is a top plan view of a curved plate incorporated in the sole structure.
Figure 8:
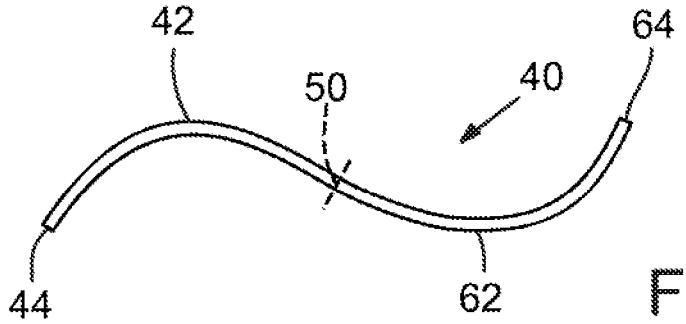
FIG. 8 is a side elevation view of the curved plate.
Figure 9:
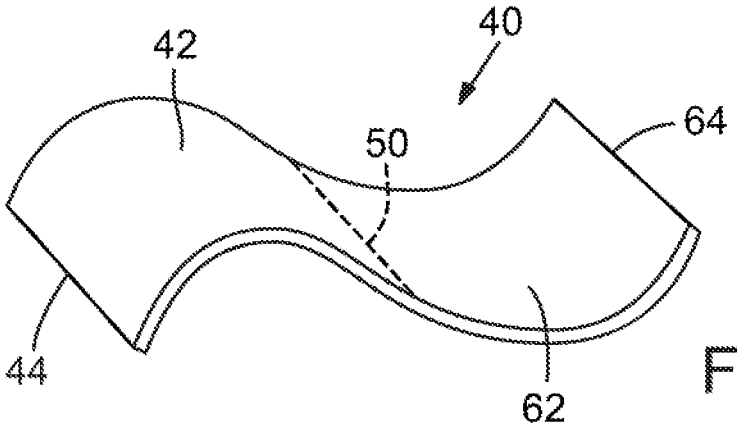
FIG. 9 is a perspective view of the curved plate.

An inflection region 50 is located on each plate 40 between the first side 42 and the second side 62. At each inflection region 50, the curvature of the corresponding plate 40 transitions from the downward-facing concavity of the first side 42 to the upward-facing concavity of the second side 62. Each plate 40 accordingly has a smoothly arcuate S-shaped curvature that extends from the first edge 44 to the second edge 64. Moreover, since the first edge 44 is proximal to a medial portion of peripheral edge 36, and since the second edge 64 is proximal to a lateral portion of peripheral edge 36, each plate 40 has an undulating medio-lateral curvature, meaning a curvature that undulates between medial side 15 and lateral side 14 of footwear 10. Moreover, FIGS. 7-9 consistently show the curved plate 40 with straight longitudinally oriented edges. FIGS. 7-9, for example, portray the first and second sides 42, 62 terminating at first and second edges 44, 64, each of which is shown with a rectilinear configuration. Likewise, the end-view illustration of the curved plate 40 presented in FIG. 8 shows the crest and trough of the first and second sides 42, 62, respectively, as level and straight. Also telling to this fact is that the longitudinally oriented dashed line used to indicate the inflection region 50 is shown in FIG. 9 as a straight, uncurving line.

Curved plates 40 are depicted in FIGS. 7-9 as layers of uniformly thick material. Curved plates 40 may be formed from or may otherwise include any of a variety of materials that are generally more rigid than the polymer foam material of midsole 31. For example, curved plates 40 may be formed from a polyester material such as a thermoplastic polyurethane (TPU). In such embodiments, a sheet of TPU may be thermoformed to have an undulating curvature, and may thereafter be embedded within midsole 31. Other materials that may also be used for curved plates 40 include: an injection-molding-grade thermoplastic or thermoset polymer material; a composite material, such as a fiber-reinforced polymer material, or carbon fiber material; an engineered textile with a fused adhesive skin; or a multi-material laminate structure. The material and thickness of curved plates 40 may accordingly allow the support and cushioning of sole structure 30 to be optimized for a particular activity, or type of athlete.

Figure 10:
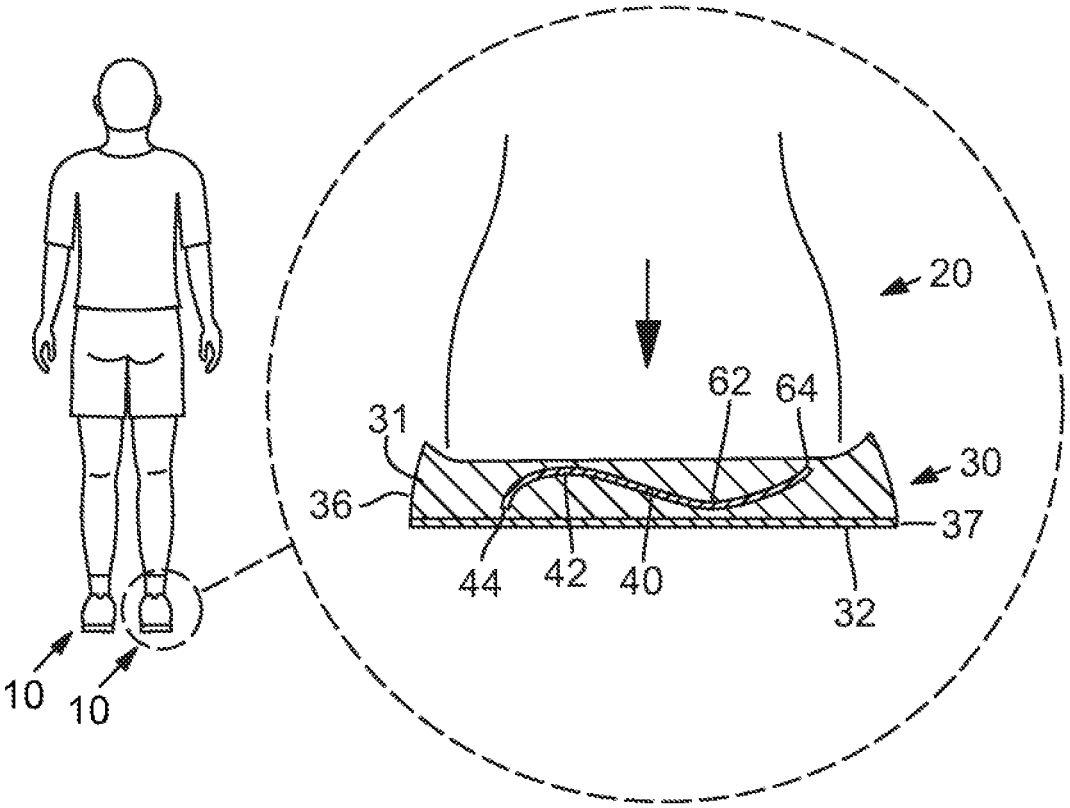
FIG. 10 is a cross-sectional view of the sole structure of FIGS. 1-6 showing possible application of a vertical force.
Figure 11:
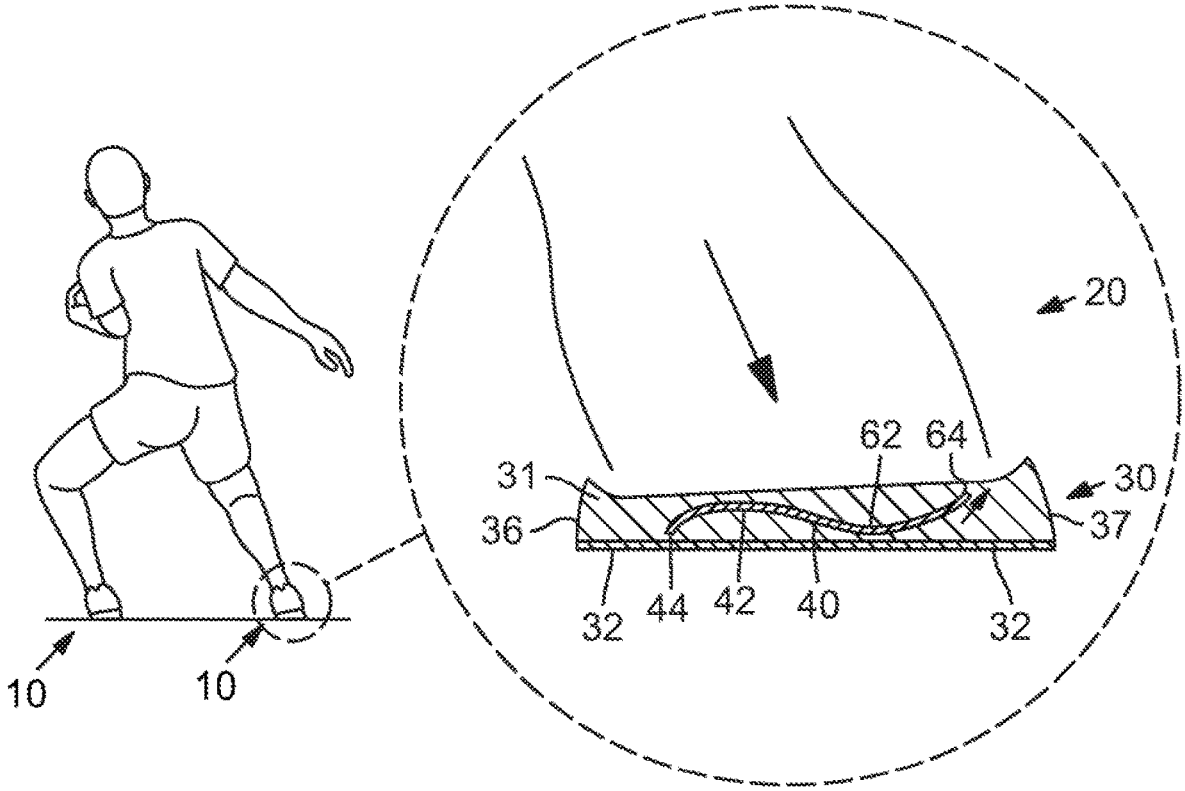
FIG. 11 is a cross-sectional view of the sole structure of FIGS. 1-6 showing possible application of a lateral or banking force.

FIGS. 10-11 depict footwear 10 under various forces. As depicted in FIG. 10, the various portions of midsole 31 may provide comparable degrees of support in response to substantially vertical or downward forces upon midsole 31, such as forces associated with standing, walking, or running. Curved plate 40 does not interfere with normal cushioning and support offered by the polymer foam of midsole 31, thereby allowing substantially symmetric medio-lateral support and cushioning during such activities as standing, walking, or running.

In contrast, midsole 31 and curved plate 40 may provide unique cushioning and support properties during banking, e.g., pushing off to the side from a medial or lateral side of the foot. A banking force may have both a downward or vertical component as well as a lateral or side-to-side component. The banking force may also be applied asymmetrically to sole structure 30 along a medio-lateral axis, and may be applied more directly to one side of footwear 10 than to another.

As depicted in FIG. 11, first side 42 of curved plate 40 may compress vertically in response to a banking force. More specifically, first side 42 compress vertically in response to the force. In turn, the vertical compression of first side 42 urges second the displacement of second edge 64 in the direction of the adjacent arrow. First side 42 of curved plate 40 may thus act as a flat spring to which second side 62 may react by being displaced outward and upward, further reinforcing lateral side 14 of midsole 31 against the applied banking force. As a result, when an athlete wearing footwear 10 applies such a banking force to midsole 31, curved plate 40 reacts to the compression of first side 42 by (a) stabilizing medial side 15 of footwear 10 and (b) providing increased support to lateral side 14 of footwear 10. Overall support of the athlete's foot during the banking maneuver may thereby be increased.

As a result of the undulating medio-lateral configuration of curved plates 40, curved plates 40 may advantageously assist the optimization of the cushioning properties of footwear 10 in response to the sorts of forces applied to footwear 10 during side-to-side or lateral banking movement.

Further Configurations

Figure 12:
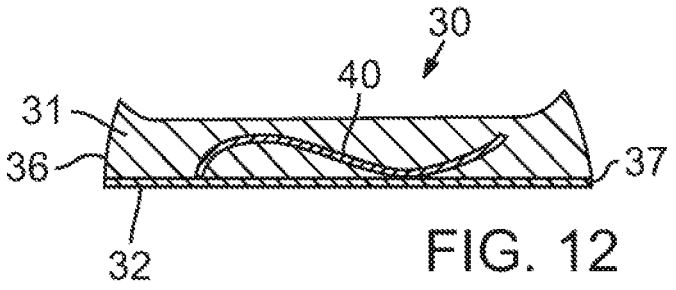
FIGS. 12-23 are cross-sectional views corresponding with FIG. 5 and depicting further configurations of the sole structure.
Figure 13:
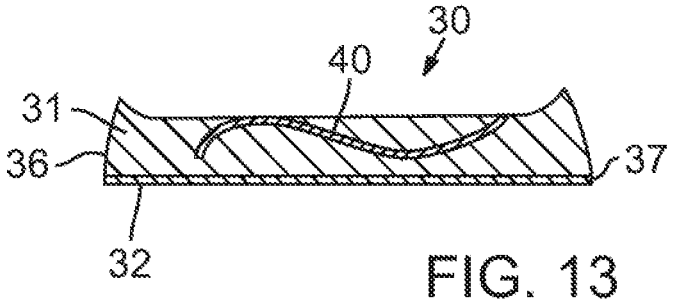

Curved plates 40 are depicted in FIGS. 3-6 as being spaced from peripheral edge 36 of midsole 31, as well as being spaced from both an upper surface and a lower surface of midsole 31. That is, curved plates 40 are depicted as being entirely embedded within the polymer foam material of midsole 31. In other configurations, plates 40 may be only partially embedded in midsole 31. For example, as depicted in FIG. 12, a curved plate 40 may be positioned at the bottom of midsole 31, and portions of curved plate 40 may form part of a lower surface of midsole 31. Similarly, curved plate 40 may be positioned at the top of midsole 31 and may form part of an upper surface of midsole 31, as depicted in FIG. 13.

Figure 5:
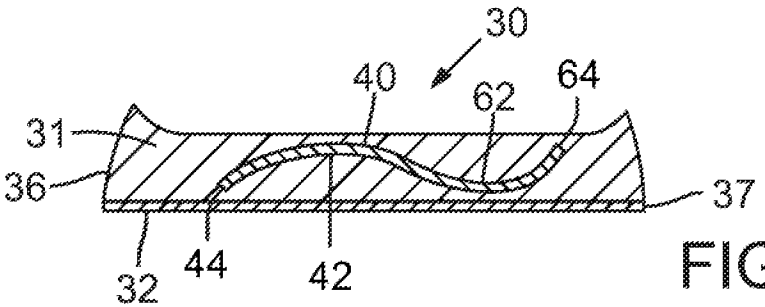
FIG. 5 is a cross-sectional view of the sole structure, as defined by section line 5-5 in FIG. 3.
Figure 6:
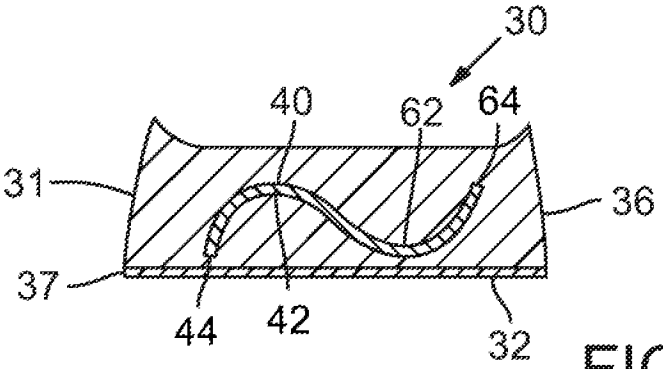
FIG. 6 is a cross-sectional view of the sole structure, as defined by section line 6-6 in FIG. 3.
Figure 14:
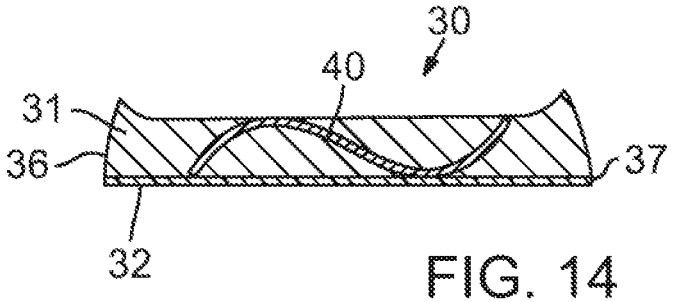
Figure 15:
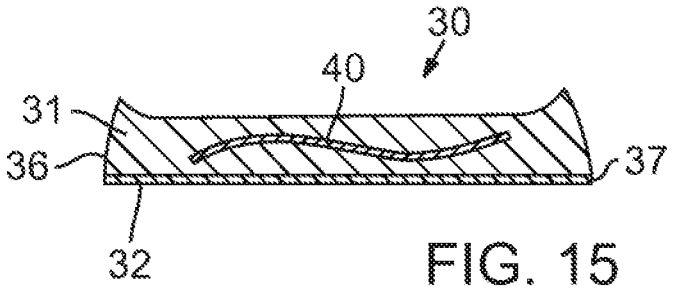

FIG. 14 depicts an alternate configuration in which curved plate 40 forms portions of both the upper surface and the lower surface of midsole 31. As depicted in FIG. 14, curved plate 40 accordingly has a height greater than the height of curved plate 40 as depicted in FIGS. 5-6. In various configurations, however, curved plate 40 may have a variety of heights. In other words, the ratio of the height of curved plate 40 to the height of midsole 31 may vary. As depicted in the alternate configuration of FIG. 15, for example, curved plate 40 may have a height less than the height of curved plate 40 as depicted in FIGS. 3-6, and the ratio of the height of curved plate 40 to the height of midsole 31 may be less than the ratio of those heights as depicted in FIGS. 5-6.

FIGS. 3-6 depict curved plates 40 as extending across at least sixty percent of a distance between a proximal medial edge of midsole 31 (i.e., a proximal portion of peripheral edge 36 on medial side 15) and a proximal lateral edge of midsole 31 (i.e., a proximal portion of peripheral edge 36 on lateral side 14). In other words, curved plates 40 extend across at least sixty percent of a proximate medio-lateral extent of midsole 31. An advantage of this medio-lateral extent of curved plates 40 is that the overall support provided to an athlete's foot during a banking maneuver (due to the compression of first side 42, and the reactive upward urging of curved plate 40 in the direction of second edge 64) may extend over more than half of a width of the footwear.

Figure 16:
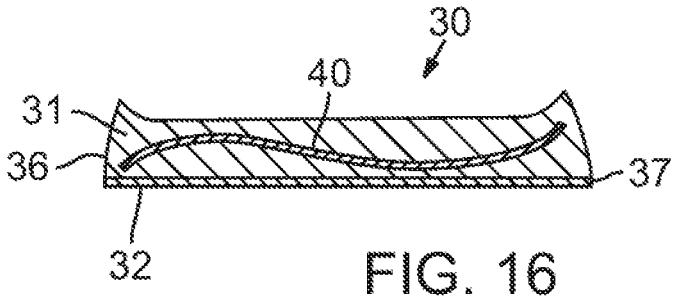
Figure 17:
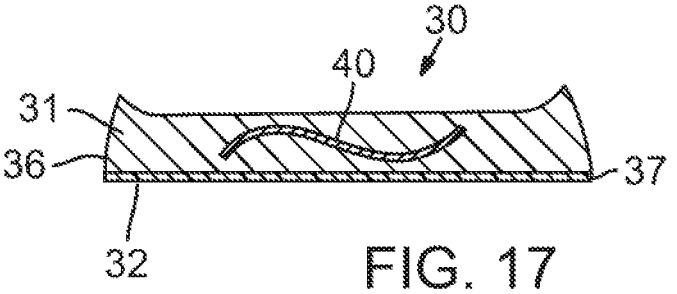

In various other configurations, however, curved plate 40 may have other degrees of medio-lateral extent. As depicted in FIG. 16, for example, curved plate 40 extends across at least eighty percent of a proximate medio-lateral extent of midsole 31. In such configurations, the overall support provided to an athlete's foot during a banking maneuver may advantageously extend over nearly all of a width of the footwear. Alternatively, other configurations of curved plate 40 may extend across less than sixty percent of a proximate medio-lateral extent of midsole 31, as depicted in FIG. 17.

Figure 18:
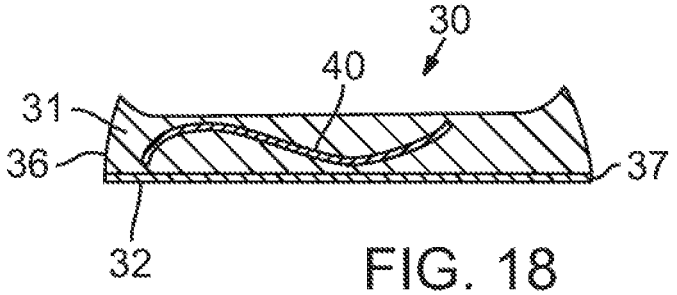
Figure 19:
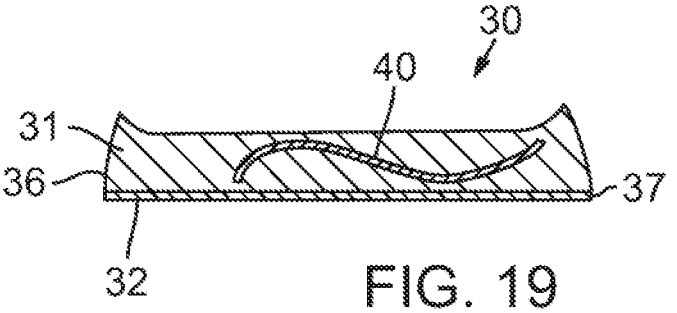

Curved plates 40 are depicted in FIGS. 3-6 as being substantially centered within midsole 31. Inflection region 50 is accordingly positioned in a central area of midsole 31, and first side 42 and second side 62 have substantially similar medio-lateral extent; however, other orientations of curved plates 40 are possible in various other configurations of footwear 10. FIGS. 18 and 19 depict two such alternate configurations of footwear 10. In the configuration of FIG. 18, curved plate 40 is closer to a proximate medial edge of midsole 31 than a proximate lateral edge of midsole 31, while in the configuration of FIG. 19, curved plate 40 is closer to a proximate lateral edge of midsole 31 than a proximate medial edge of midsole 31.

Figure 26:
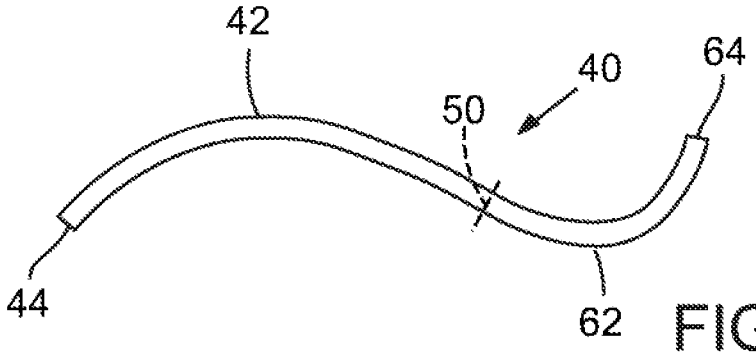
Figure 27:
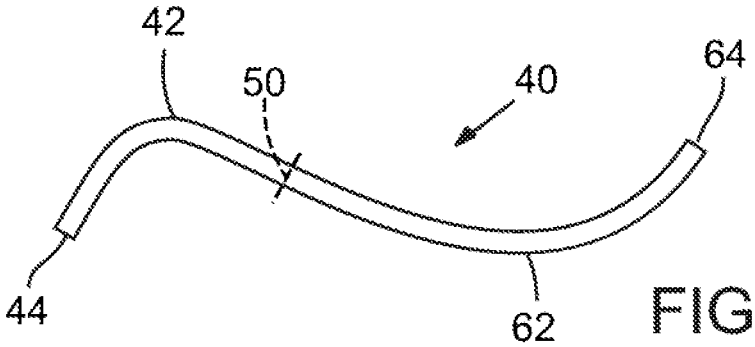

Moreover, while FIGS. 3-6 depict inflection region 50 of curved plate 40 as being in a central are of curved plate 40, region 50 may be otherwise positioned along the medio-lateral extent of curved plate 40. As depicted in FIG. 26, for example, inflection region 50 is positioned closer to second edge 64 than to first edge 44, and first side 42 is accordingly wider (i.e., has a greater medio-lateral extent) than second side 62. In contrast, as depicted in FIG. 27, inflection region 50 is positioned closer to first edge 44 than to second edge 64, and second side 42 is accordingly wider than first side 42.

In FIGS. 3-6, first sides 42 and second edges 64 of each curved plate 40 are depicted as being comparably spaced from an upper surface of midsole 31. Similarly, second sides 62 and first edges 44 of each curved plate 40 are depicted as being comparably spaced from a lower surface of midsole 31. In other configurations, the sides and edges of curved plates 40 may be differently spaced from the upper and lower surfaces of midsole 31.

Figure 20:
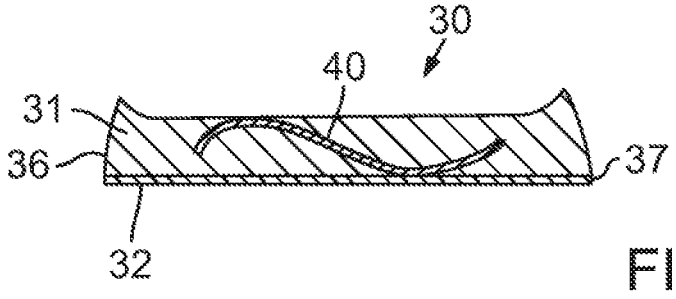
Figure 21:
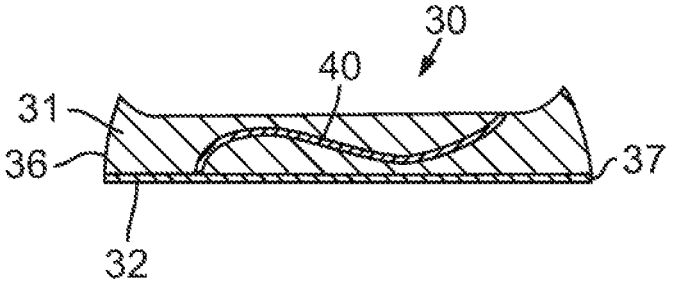

FIG. 20, for example, depicts a configuration of midsole 31 in which first edge 44 is spaced further from the lower surface of midsole 31 than second side 62, and second edge 64 is spaced further from the upper surface of midsole 31 than first side 42. In contrast, in the exemplary configuration depicted in FIG. 21, second side 62 is spaced further from the lower surface of midsole 31 than first edge 44, and first side 42 is spaced further from the upper surface of midsole 31 than second edge 64.

Figure 22:
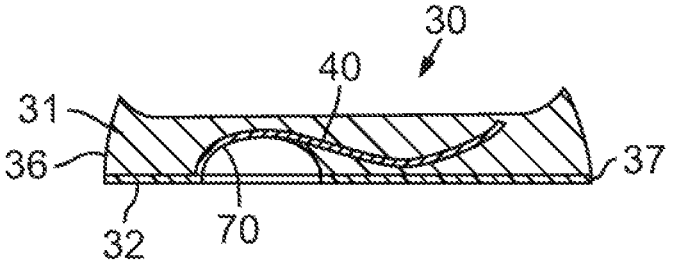

Although midsole 31 is depicted in FIGS. 3-6 as only including a polymer foam material and curved plates 40, midsole 31 may include other features, such as other types of plates, moderators, fluid-filled chambers, lasting elements, or motion control members. Some configurations of midsole 31, like the configuration depicted in FIG. 22, may include an aperture in outsole 32 that exposes an upwardly-extending arcuate recess 70 in midsole 31. Curved plate 40 may have a shape that conforms either partially or entirely to the contour of recess 70, both in a medio-lateral direction and a in a forefoot-rearfoot direction.

Figure 23:
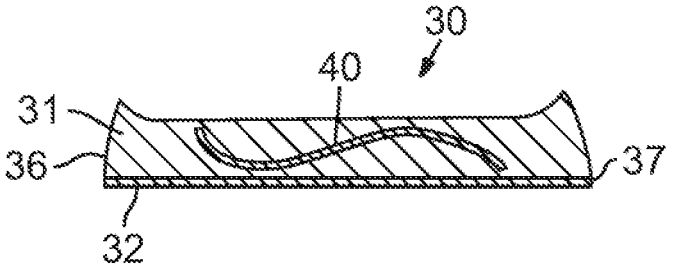

As discussed above with respect to FIGS. 3-6, curved plates 40 have downwardly-concave first sides 42 positioned on medial side 15 and upwardly-concave second sides 62 positioned on lateral side 14. However, in other configurations, curved plates 40 may have upwardly-concave first sides 42 positioned on medial side 15, and downwardly-concave second sides 62 positioned on lateral side 14, as depicted in FIG. 23. Any curved plate 40 may accordingly have both an upwardly-concave side and a downwardly-concave side, and the downwardly-concave side may be either (a) between the upwardly-concave side and a lateral edge of the midsole, or (b) between a medial edge of the midsole and the upwardly-concave side.

Figure 24:
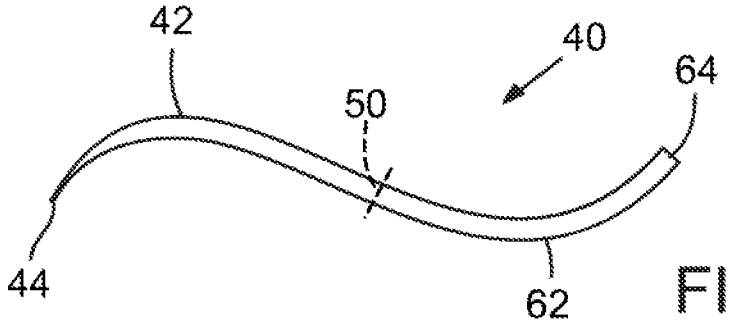
FIGS. 24-27 are side elevation views corresponding with FIG. 8 and depicting further configurations of the curved plate.
Figure 25:
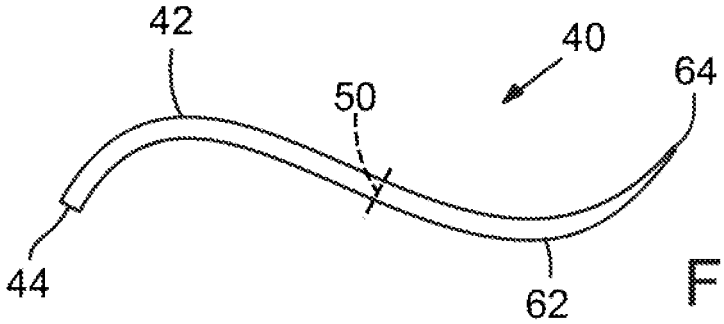

Additionally, while curved plates 40 are depicted in FIGS. 5-6 and 8-9 as layers of uniformly thick material, curved plates 40 may in some configurations have a non-uniform thickness, i.e., a thickness of a curved plate 40 may vary between portions of plate 40. As depicted in FIGS. 24-25, for example, downwardly-concave first side 42 may include a tapered edge 44 located proximal to a medial edge of midsole 31, or upwardly-concave second side 62 may include a tapered edge 64 proximal to a lateral edge of midsole 31. In various configurations, first side 42, second side 62, or both may taper to their respective edges 44 and 64.

Figure 28:
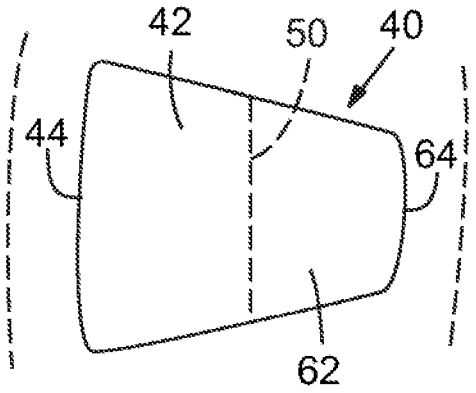
FIGS. 28-31 are top plan views corresponding with FIG. 7 and depicting further configurations of the curved plate.
Figure 29:
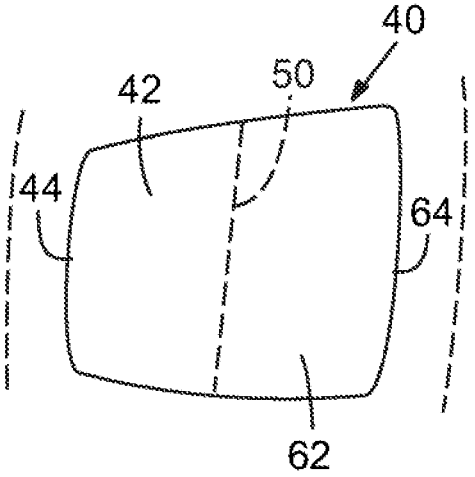

FIGS. 3 and 7-9 depict curved plates 40 as having substantially rectangular configurations, i.e., as having edges 44 and 64 of substantially the same length, and forward edges and rearward edges that are substantially parallel. However, as depicted in FIGS. 28 and 29, edges 44 and 64 may have different lengths, and curved plate 40 may have forward edges and rearward edges that are not parallel.

Figure 30:
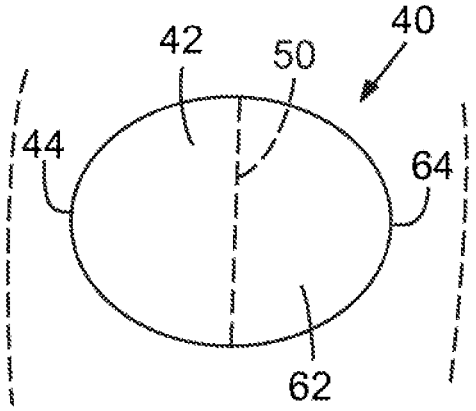
Figure 31:
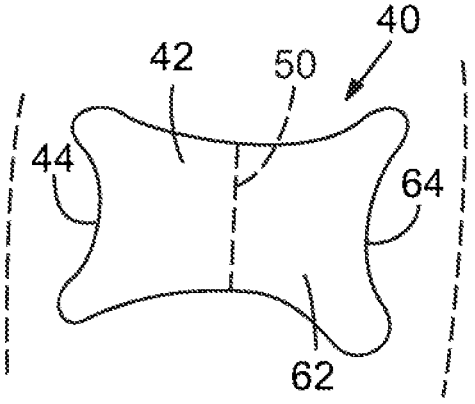

In some configurations, like the exemplary configuration depicted in FIG. 30, curved plates 40 may have a convex arcuate shape with curved edges 44 and 64, such as a lozenge shape, or elliptical shape, or oval shape, or egg shape. More generally, curved plates 40 may have any of a variety of convex shapes, including circular, triangular, square, rectangular, or hexagonal shapes, or other regular geometrical shapes. In other configurations, however, curved plates 40 may have non-convex shapes with outwardly-extending protrusions, or any other irregular shape, such as the non-convex shape depicted in FIG. 31.

Figure 3:
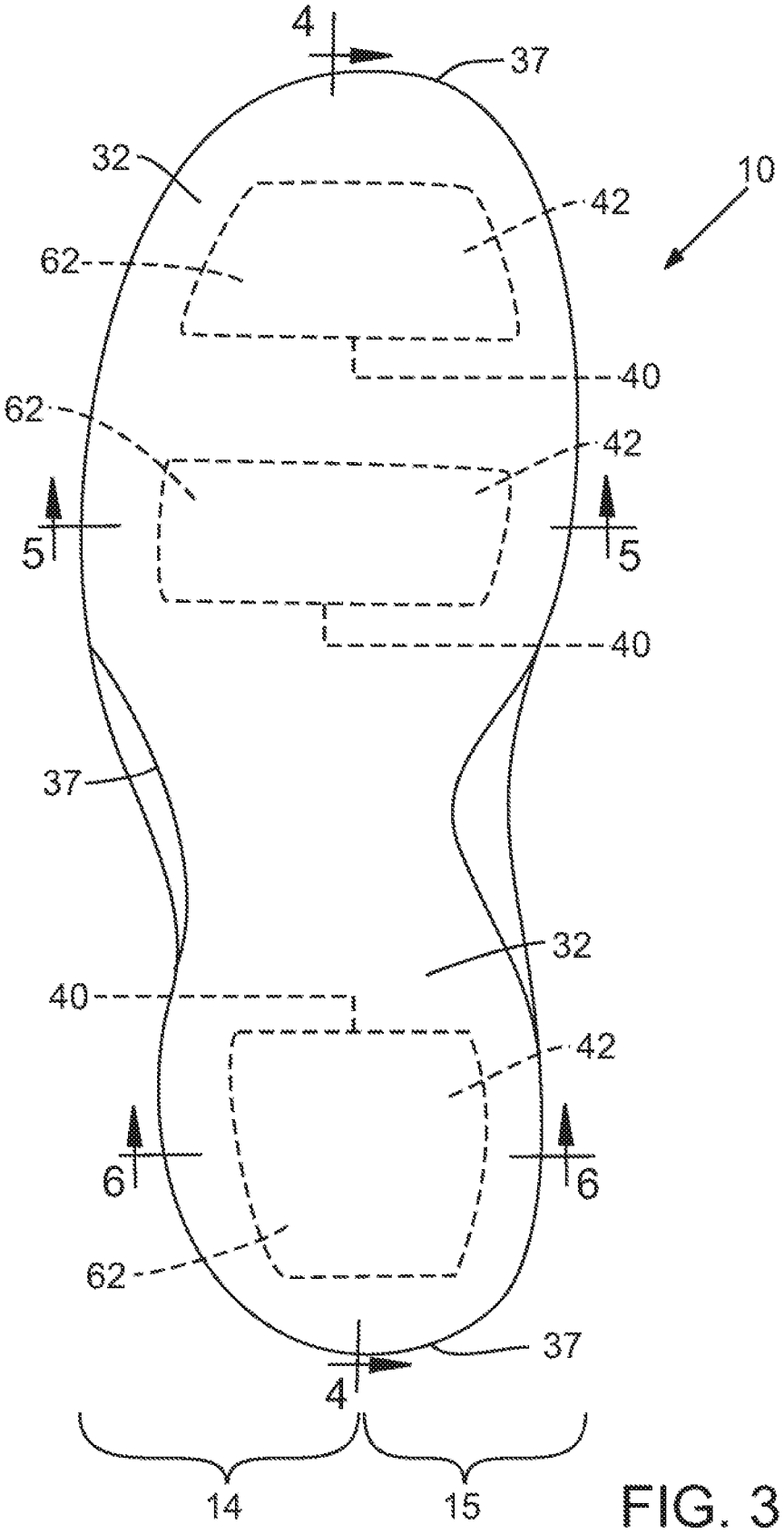
FIG. 3 is a bottom plan view of the article of footwear.
Figure 32:
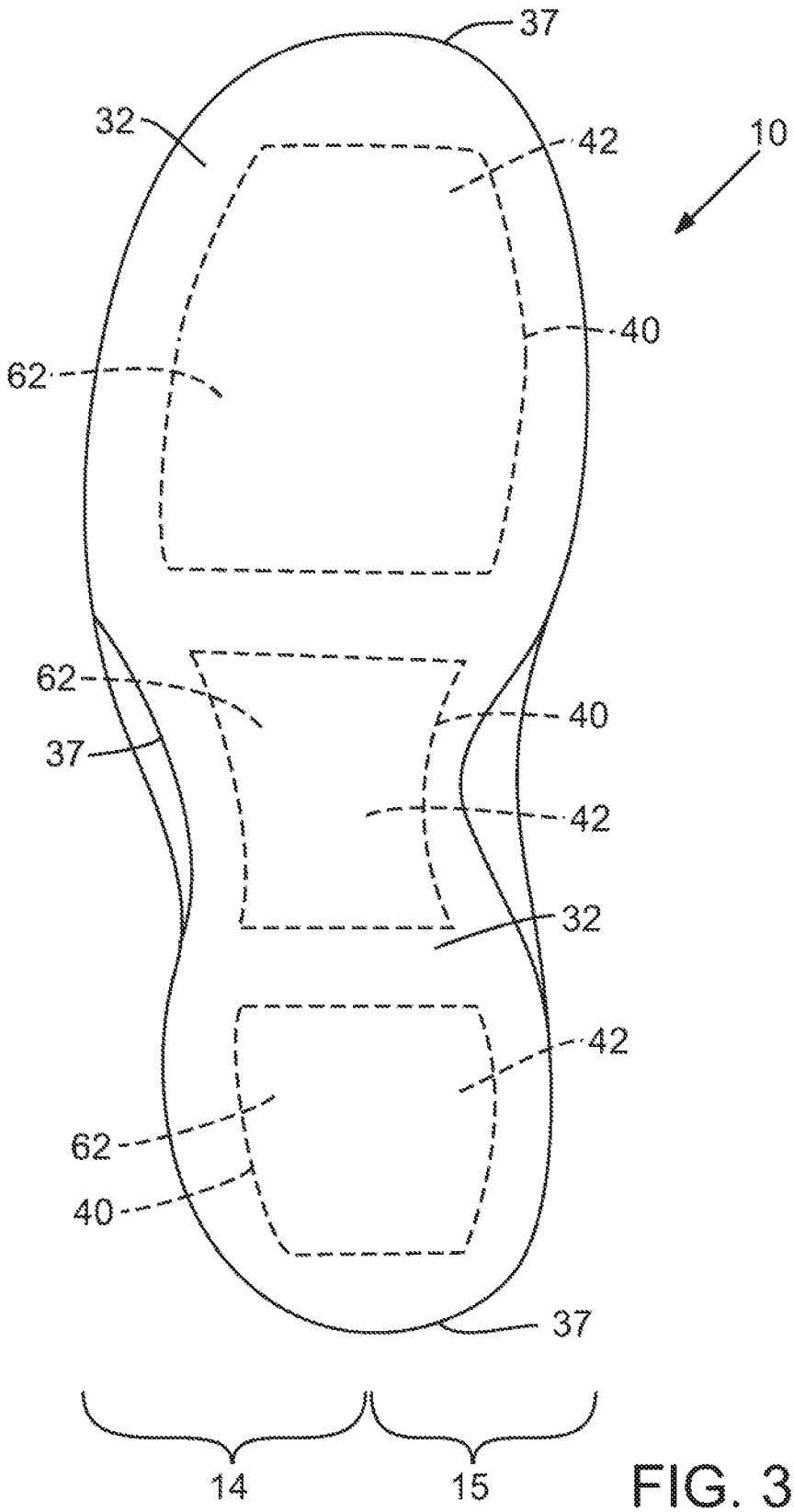
FIGS. 32-34 are bottom plan views corresponding with FIG. 3 and depicting further configurations of the article of footwear.
Figure 33:
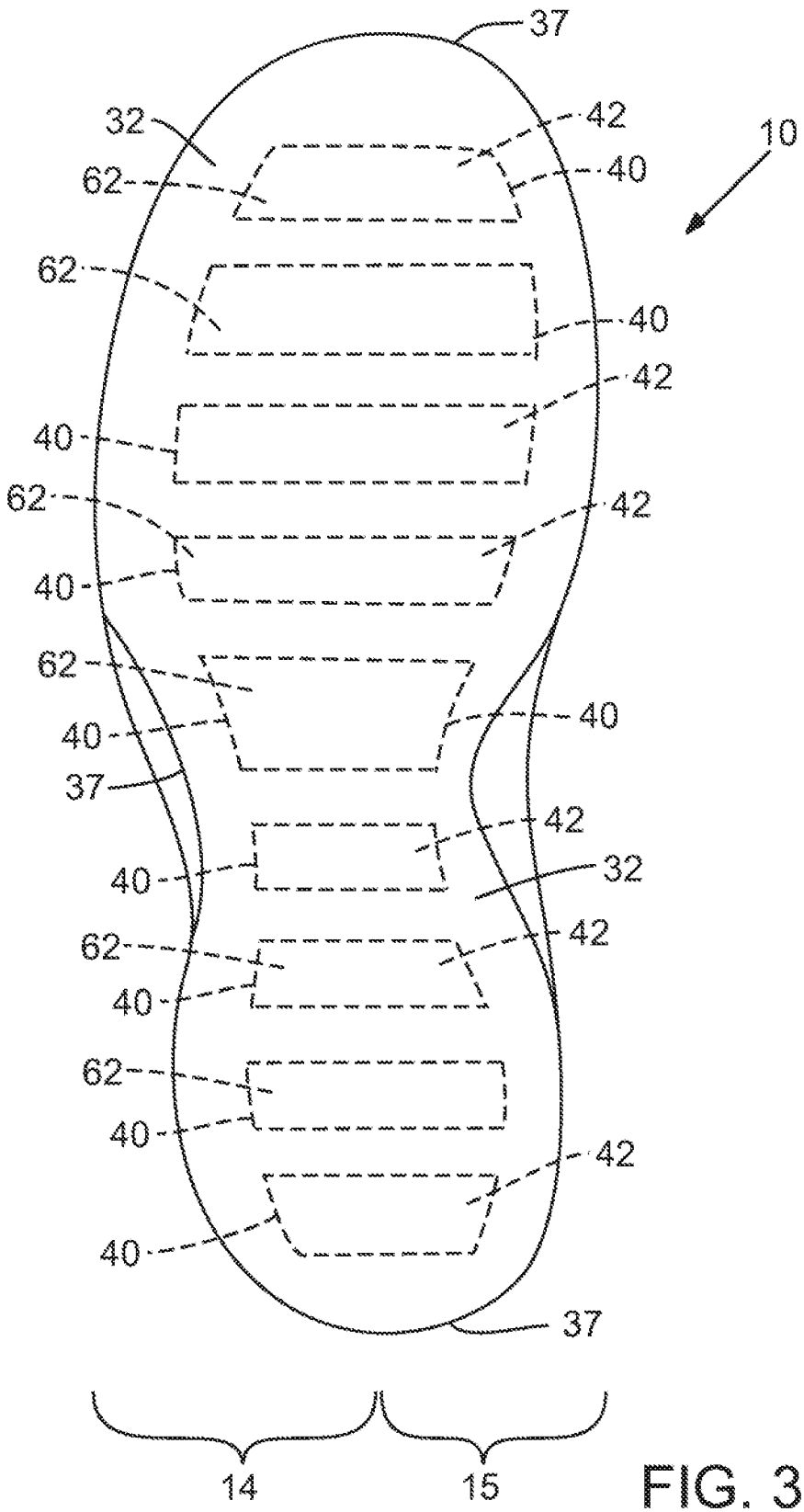

While FIG. 3 depicts footwear 10 as including two curved plates 40 positioned in forefoot region 11 and one curved plate 40 positioned in heel region 13, any number of curved plates may be positioned in a variety of manners throughout midsole 31. FIG. 32, for example, depicts a configuration in which a single curved plate is positioned in each of forefoot region 11, midfoot region 12, and heel region 13, while FIG. 33 depicts a configuration with many curved plates 40 positioned throughout regions 11-13. Any of forefoot region 11, midfoot region 12, or heel region 13 may accordingly include one or more curved plates 40.

Figure 34:
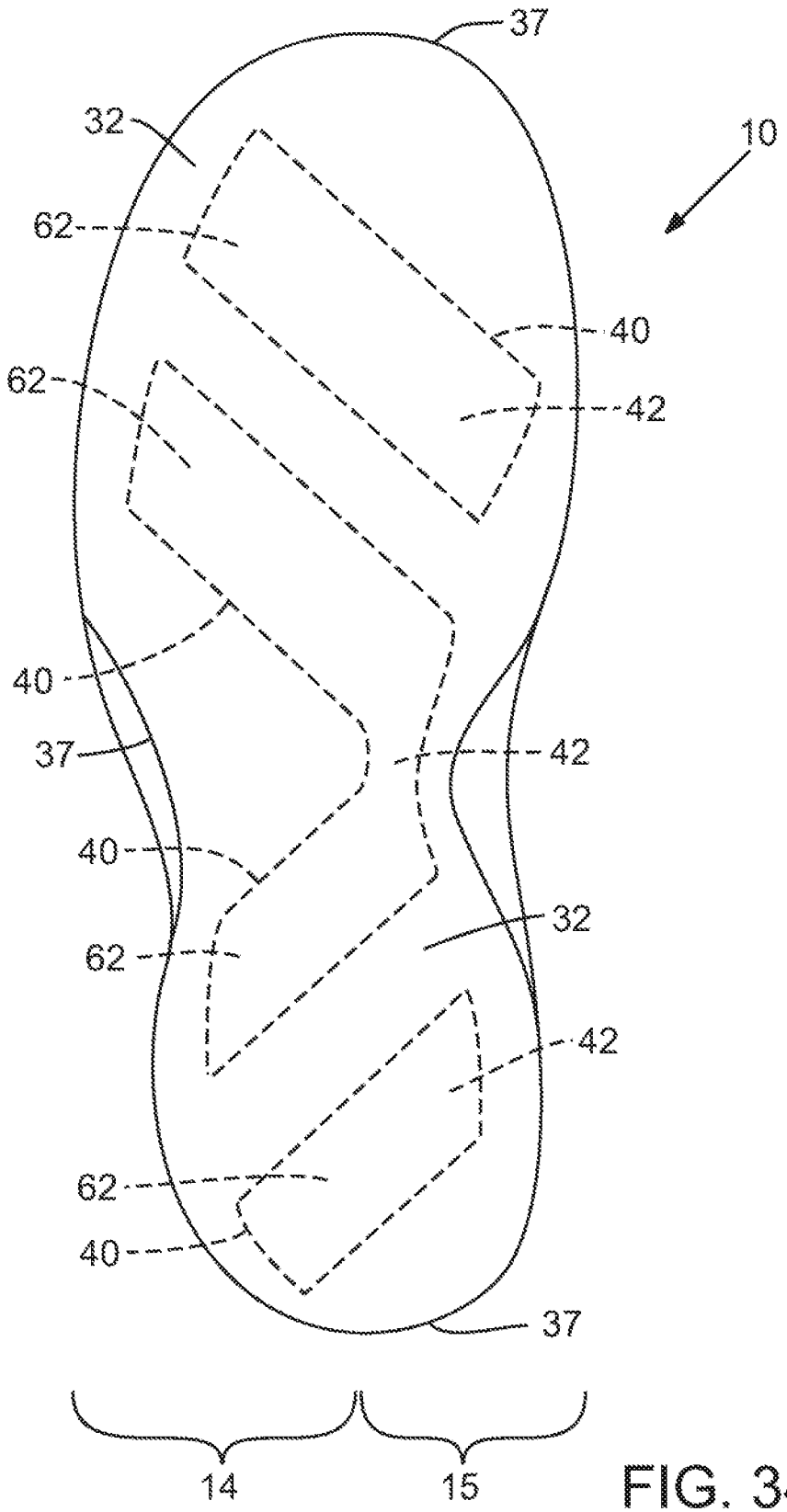

In addition, although curved plates 40 are depicted in FIGS. 3-6 as extending across a substantially medio-lateral portion of midsole 31, plates 40 may also extend at least partially in a forefoot-rearfoot direction. FIG. 34 depicts an exemplary configuration in which a curved plate 40 in forefoot region 11 and a curved plate in heel region 13 each extend in both a medio-lateral direction and a forefoot-rearfoot direction, and a third, V-shaped curved plate 40 also extends in both a medio-lateral direction and a forefoot-rearfoot direction.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims. Moreover, the present concepts expressly include any and all combinations and subcombinations of the preceding elements and features.

What is claimed:

1. A sole structure for an article of footwear having an upper, the sole structure comprising:

a midsole formed from a foam material and defining a midsole longitudinal axis extending through a forefoot region, a midfoot region, and a heel region; and a plurality of independent elongate engineered textiles including a first elongate engineered textile in the forefoot region, a second elongate engineered textile in the midfoot region, and a third elongate engineered textile in the heel region, each of the elongate engineered textiles having a fused adhesive skin fully encapsulated within the foam material of the midsole and including (i) a respective textile longitudinal axis that extends transverse to the midsole longitudinal axis between a medial side of the midsole and a lateral side of the midsole and (ii) an S-shaped cross-sectional profile extending along the direction of the midsole longitudinal axis.

2. The sole structure of claim 1, wherein each of the elongate engineered textiles includes a concave surface facing away from a ground-contacting surface of the sole structure.

3. The sole structure of claim 2, wherein each of the elongate engineered textiles includes a convex surface facing away from the upper of the article of footwear.

4. The sole structure of claim 1, wherein each of the elongate engineered textiles includes a convex surface facing away from the upper of the article of footwear.

5. The sole structure of claim 1, wherein each of the elongate engineered textiles includes a greater rigidity than the foam material of the midsole.

6. The sole structure of claim 1, wherein each of the elongate engineered textiles is spaced apart from a medial edge of the sole structure by a first distance and from a lateral edge of the sole structure by a second distance, the first distance being the same as the second distance.

7. The sole structure of claim 1, wherein each of the elongate engineered textiles is spaced apart from a medial edge of the sole structure by a first distance and from a lateral edge of the sole structure by a second distance, the first distance being different than the second distance.

8. An article of footwear incorporating the sole structure of claim 1.

9. The article of footwear of claim 1, wherein each of the elongate engineered textiles includes a first arcuate portion with a first edge disposed at a first end of the textile longitudinal axis and defining a downward-facing concavity, a second arcuate portion with a second edge disposed at an opposite second end of the textile longitudinal axis and defining an upward-facing concavity, and an inflection region connecting the first arcuate portion and the second arcuate portion, the upward-facing concavity being positioned between the downward-facing concavity and the lateral edge of the midsole or the medial edge of the midsole, and wherein the first edge is positioned below the horizontal plane substantially parallel to the footbed of the midsole and passing through the inflection region, and the second edge is positioned above the horizontal plane.

10. A sole structure for an article of footwear having an upper, the sole structure comprising:

a midsole formed from a foam material and defining a footbed and a first longitudinal axis extending through a forefoot region, a midfoot region, and a heel region; and an engineered textile with a fused adhesive skin fully encapsulated within the foam material of the midsole and including a curved cross-section that includes (i) a textile longitudinal axis that extends transverse to the first longitudinal axis between a medial side of the midsole and a lateral side of the midsole and (ii) an S-shaped cross-sectional profile extending along the direction of the first longitudinal axis and including (a) a first arcuate portion terminating at a first edge at a first end of the textile longitudinal axis and (b) a second arcuate portion terminating at a second edge at an opposite second end of the textile longitudinal axis, the first edge extending in a direction away from the footbed and the second edge extending in a direction toward the footbed;

wherein the first arcuate portion defines a downward-facing concavity, the second arcuate portion defines an upward-facing concavity, and an inflection region connecting the first arcuate portion and the second arcuate portion, the upward-facing concavity being positioned between the downward-facing concavity and a lateral edge of the midsole or a medial edge of the midsole, and wherein the first edge is positioned below a horizontal plane substantially parallel to the footbed and passing through the inflection region, and the second edge is positioned above the horizontal plane.

11. The sole structure of claim 10, wherein the engineered textile includes a greater rigidity than the foam material of the midsole.

12. The sole structure of claim 10, wherein the engineered textile is disposed in a forefoot region of the sole structure.

13. The sole structure of claim 10, wherein the engineered textile is spaced apart from a medial edge of the sole structure by a first distance and from a lateral edge of the sole structure by a second distance, the first distance being the same as the second distance.

14. The sole structure of claim 10, wherein the engineered textile is spaced apart from a medial edge of the sole structure by a first distance and from a lateral edge of the sole structure by a second distance, the first distance being different than the second distance.

15. An article of footwear incorporating the sole structure of claim 10.

* * * * *